US005773208A

United States Patent [19]

Hall et al.

[11] Patent Number: 5,773,208

[45] Date of Patent: Jun. 30, 1998

[54] LATENT IMAGE KEEPING IMPROVEMENT WITH A HEXOSE REDUCTONE AND GREEN SENSITIZED EPITAXIALLY-FINISHED TABULAR GRAIN EMULSIONS

[75] Inventors: Jeffrey L. Hall; James H. Reynolds, both of Rochester, N.Y.

[73] Assignee: Eastman Kodak Company, Rochester, N.Y.

[21] Appl. No.: 757,362

[22] Filed: Nov. 27, 1996

[51] Int. Cl.[6] ..... G03C 1/06

[52] U.S. Cl. ..... 430/607; 430/448; 430/486; 430/567; 430/434; 430/442; 430/464; 430/599; 430/600; 430/603; 430/604; 430/605; 430/611; 430/613; 430/614; 430/615

[58] Field of Search ..... 430/448, 486, 430/567, 566, 564, 343, 442, 464, 599, 650, 603, 604, 605, 607, 611, 613, 614, 615

[56] References Cited

U.S. PATENT DOCUMENTS

| | | | |
|---|---|---|---|
| 2,936,308 | 5/1960 | Hodge | 430/483 |
| 3,667,956 | 6/1972 | Mitsuto et al. | 430/553 |
| 3,695,888 | 10/1972 | Hiller et al. | 430/567 |

FOREIGN PATENT DOCUMENTS 335 107 10/1989 European Pat. Off. .

OTHER PUBLICATIONS

Research Disclosure 37038, Feb. 1995, pp. 79–115.

*Primary Examiner*—Geraldine Letscher
*Attorney, Agent, or Firm*—Paul A. Leipold

[57] ABSTRACT

The invention relates to an emulsion comprising silver halide grains, said grains being tabular and comprising sensitizing dye(s) and silver salt epitaxial deposits, and addenda that include a tetraazaindene and a hexose reductone represented by Formula I:

I wherein $R_1$ and $R_2$ are the same or different, and may represent H, alkyl, cycloalkyl, aryl, or an alkyl group with a solubilizing group such as —OH, sulfonamide, sulfamoyl, or carbamoyl. Alternatively, $R_1$ and $R_2$ may be joined to complete a heterocyclic ring such as aziridinyl, azetidinyl, pyrrolidinyl, piperidinyl, morpholinyl, piperazinyl, or pyridinyl, $R_4$ and $R_5$ are H, OH, alkyl, aryl, cycloalkyl, or may together represent an alkylidene group, n is 0,1, or 2 and $R_3$ is H, alkyl, aryl, or $CO_2R_6$ where $R_6$ is alkyl.

39 Claims, No Drawings

LATENT IMAGE KEEPING IMPROVEMENT WITH A HEXOSE REDUCTONE AND GREEN SENSITIZED EPITAXIALLY-FINISHED TABULAR GRAIN EMULSIONS

FIELD OF THE INVENTION

This invention relates to photography. It particularly relates to the stabilization of the latent image of an emulsion.

BACKGROUND OF THE INVENTION

The ability to discriminate between exposed and unexposed areas of photographic film or paper is the most basic requirement of any photographic recording device. In a normal sequence, the exposed photographic element is subjected to a chemical developer, wherein a very large amplification is effected through production of metallic silver as a result of catalytic action of small latent image centers that are believed to be small silver or silver and gold clusters. The resulting silver then forms the final image in many black and white products, or oxidized developer resulting from the silver reduction reaction can be reacted with couplers to form image dye. In either case, because of the thermodynamic driving force of the chemical developer to reduce silver halide to silver, it is not surprizing that achievement of the desired discrimination between exposed and unexposed regions of a photographic element continues to challenge photographic scientists: Any non-image catalytic center will facilitate the unwanted production of metallic silver and image dye in unexposed areas during the development process. These non-image catalytic centers can come from one or more of various sources. For example, they may be the result of an inadvertant reductive process that generates Ag centers, they may be silver sulfide or silver/gold sulfide centers that result from inadvertant oversensitization, or they may result from trace metals such as iron, lead, tin, copper, nickel, and the like from raw materials and/or manufacturing equipment. Whatever the cause, it is the most basic goal of photographic technology to provide excellent discrimination depending on exposure or lack of it.

There are three additional goals that are closely related to the one just stated. The first is to provide film and paper that have uniform response characteristics within and between manufacturing events. For this reason, it is essential that sensitized emulsions remain stable prior to being coated in product. A second goal is that sensitivity of coated product should remain relatively unchanged over a convenient shelf storage time interval, which is generally referred to as good raw stock stability. The third goal relates to stability of latent image, which must be high so that apparent sensitivity remains relatively unchanged from beginning to end of a particular roll of film, even when the exposure sequence is extended over several weeks. This invention is directed to all these goals, namely to achieving sharp discrimination between exposed and unexposed regions, excellent stability of sensitized emulsions (and corresponding high product uniformity), and excellent raw stock and latent image stability.

In recent years, the utility of tabular grain emulsions has become evident following disclosures of Kofron et al U.S. Pat. No. 4,439,520. An early cross-referenced variation on the teachings of Kofron et al was provided by Maskasky U.S. Pat. No. 4,434,501. Maskasky demonstrated significant increases in photographic sensitivity as a result of selected site sensitizations involving silver salt epitaxy. Still more recently, Antoniades et al U.S. Pat. No. 5,250,403 taught the use of ultrathin tabular grain emulsions in which the tabular grains have an equivalent circular diameter (ECD) of at least 0.7 μm and a mean thickness of less than 0.07 μm, and in which tabular grains account for greater than 97 percent of the total grain projected area. Coassigned patents and patent applications teach epitaxial sensitization of ultrathin tabular emulsions in which the host and epitaxy have preferred composition or dopant management (U.S. Pat. No. 5,503,970, EP 95 420 236.2, U.S. Pat. Nos. 5,503,971, 5,494,789, U.S. Ser. No. 08/363,477 filed Dec. 23, 1994, U.S. Ser. No. 08/363,480 filed Dec. 23, 1994, U.S. Pat. No. 5,536,632, U.S. Ser. No. 08/590,961 filed Jan. 24, 1996, U.S. Ser. No. 08/441,489 filed May 15, 1995, U.S. Ser. No. 08/441,491 filed May 15, 1995, U.S. Ser. No. 08/442,228 filed May 15, 1995, and EP 95 420 237.0).

Epitaxially sensitized emulsions in general, and epitaxially sensitized ultrathin tabular emulsions in particular, present some unique challenges in selection of antifoggants and stabilizers. This is due to the presence of at least two different silver salt compositions in the same emulsion grains. Thus, in the case of Ag(Br,I) hosts that have AgCl-containing epitaxy deposited on them, it is not immediately evident whether addenda should be selected that are appropriate to the Ag(Br,I) host or to the AgCl-containing epitaxy. It is further complicated by the fact that the host and epitaxy will likely have different exposed crystal lattice planes, and what adsorbs to host planes may not adsorb to those of the epitaxy, or an addendum that stablizes one surface may destabilize the other. Moreover, there is a strong entropic driving force for the Ag(Br,I) host and AgCl regions to recrystallize to form a single uniform composition (C. R. Berry in *The Theory of the Photographic Process, 4th Ed.*, T. H. James, Ed., New York: Macmillan Publishing Co., Inc., (1977), p.94f). Finally, if the Ag(Br,I) host is ultrathin, there is the additional strong tendency for Ostwald ripening to occur due to the high surface energy resulting from their large surface area/volume ratio (C. R. Berry, loc cit, p 93). For these reasons, choice of antifogging addenda for epitaxially sensitized ultrathin tabular grain emulsions is not at all obvious.

Maskasky, J. E., U.S. Pat. No. 4,435,501, columns 35 and 36, provides an extensive list of stabilizers and antifoggants for epitaxially sensitized emulsions, drawn from prior disclosures of such addenda on nonepitaxially sensitized emulsions, but no specific data to illustrate their effectiveness. Not all of the materials suggested by Maskasky are equally effective. Corben, L. D., U.S. Pat. No. 4,332,888, and Himmelwright et al, U.S. Pat. No. 4,888,273 describe emulsion stabilizers comprising 1-phenyl-5-mercaptotetrazole and a tri- tetra- or pentaazaindene, or a 1-phenyl-5-mercaptotetrazole with phenyl substitution and azaindene.

PROBLEM TO BE SOLVED BY THE INVENTION

It is important to note that while a uniform material exhibiting discrimination between exposed and nonexposed areas, along with excellent raw stock and latent image stability are very basic requirements of a photographic film or paper, they are by no means the only ones. In particular, it is highly desirable to achieve the desired discrimination and stabilization without degradation of sensitivity or image structure.

There is a continuing need for methods of improving the speed/fog characteristics and latent image stability characteristics of epitaxially sensitized ultrathin tabular grain emulsions.

SUMMARY OF THE INVENTION

The invention provides an emulsion comprising silver halide grains, said grains being tabular and comprising sensitizing dye(s) and silver salt epitaxial deposits, and addenda that include a tetraazaindene and a hexose reductone represented by Formula I:

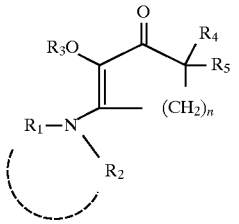

I wherein $R_1$ and $R_2$ are the same or different, and may represent H, alkyl, cycloalkyl, aryl, or an alkyl group with a solubilizing group such as —OH, sulfonamide, sulfamoyl, or carbamoyl. Alternatively, $R_1$ and $R_2$may be joined to complete a heterocyclic ring such as aziridinyl, azetidinyl, pyrrolidinyl, piperidinyl, morpholinyl, piperazinyl, or pyridinyl, $R_4$ and $R_5$ are H, OH, alkyl, aryl, cycloalkyl, or may together represent an alkylidene group, n is 0,1, or 2 and $R_3$ is H, alkyl, aryl, or $CO_2R_6$ where $R_6$ is alkyl.

In a preferred embodiment, the reductone comprises Formula IA:

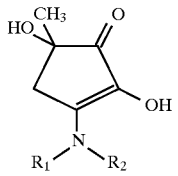

IA wherein $R_1$=$R_2$=$CH_3$ HR-1

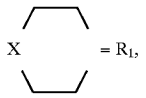

X=O HR-2

X=$CH_2$ HR-3

ADVANTAGEOUS EFFECT OF THE INVENTION

The invention provides a photographic element using epitaxially finished ultrathin tabular grain emulsions that have excellent latent image keeping performance.

DETAILED DESCRIPTION OF THE INVENTION

The emulsion of the invention surprisingly produces improved latent image keeping and curve shape control while free of mercaptotetrazole. It is surprising that an emulsion free of mercaptotetrazole exhibits low fog when hexose reductone is present, as well as very good latent image keeping.

The invention has many advantages over prior sensitization for tabular emulsions. The invention finds particular use in ultrathin emulsions that have epitaxy. The combination of tetraazaindene and hexose reductone, particularly in the preferred ranges, provides an emulsion that is stable with good latent image keeping properties. Further, the grains have improved speed/fog characteristics, either decreased fog at a particular speed, increased speed at a given fog, or both increased speed and decreased fog. These advantages will be obvious from the description below.

The ultrathin grains of the invention having epitaxial areas may be formed by any technique. Particularly desirable for the invention are those grains as disclosed in U.S. Pat. No. 5,503,970, EP 95 420 236.2, U.S. Pat. Nos. 5,503,971, 5,494,789, U.S. Ser. No. 08/363,477 filed Dec. 23, 1994, U.S. Ser. No. 08/363,480 filed Dec. 23, 1994, U.S. Pat. No. 5,536,632, U.S. Ser. No. 08/590,961 filed Jan. 24, 1996, U.S. Ser. No. 08/441,489 filed May 15, 1995, U.S. Ser. No. 08/441,491 filed May 15, 1995, U.S. Ser. No. 08/442,228 filed May 15, 1995, and EP 95 420 237.0 which are coassigned and are hereby incorporated by reference. The preferred emulsions of the invention are a radiation-sensitive emulsion comprised of a dispersing medium, silver halide grains including tabular grains, said tabular grains (a) having {Ill} major faces, (b) containing greater than 70 mole percent bromide and at least 0.25 mole percent iodide, based on silver, (c) accounting for greater than 90 percent of total grain projected area, (d) exhibiting an average equivalent circular diameter of at least 0.7 $\mu$m, (e) exhibiting an average thickness of less than 0.07 $\mu$m, and (f) having latent image forming chemical sensitization sites on the surfaces of the tabular grains, and forming the edges and corners of the tabular grains, and a spectral sensitizing dye adsorbed to at least the major faces of the tabular grains, wherein the surface chemical sensitization sites include at least one silver salt epitaxially located on and confined to the laterally displaced regions of said tabular grains.

Preferred emulsions have tabular grains that account for greater than 97 percent of the total grain projected area and may contain a photographically useful dopant that results in reduced reciprocity failure or increased photographic speed. The preferred emulsions of the invention are those wherein the central regions contain less than half the iodide concentration of the laterally displaced regions and at least a 1 mole percent lower iodide concentration than the laterally displaced regions. In preferred grains of the invention, the silver salt is predominantly located adjacent the edges of the tabular grain, and it is most preferred that it be located adjacent the corners of the tabular grains. The ultrathin tabular grains may be comprised of silver chloride, silver bromoiodide, or silver bromide. The grains generally have a lower concentration level of iodide in the central regions than at the edges.

In one preferred embodiment the silver salt epitaxy (a) is of isomorphic face centered cubic crystal structure, (b) includes at least a 10 mol % higher chloride ion concentration than the tabular grains, and (c) includes an iodide concentration that is increased by iodide addition during the epitaxy formation step.

In another preferred embodiment the silver salt epitaxy contains a photographically useful metal ion dopant in which said metal ion displaces silver in the crystal lattice of the epitaxy, exhibits a positive valence of from 2 to 5, and has its highest energy electron occupied molecular orbital filled and its lowest energy unoccupied molecular orbital at an energy level higher than the lowest energy conduction band of the silver halide lattice forming the epitaxial protusions.

Aside from the features of spectrally sensitized, silver salt epitaxy sensitized ultrathin tabular grain emulsions described above, the emulsions of this invention and their preparation can take any desired conventional form. For example, although not essential, after a novel emulsion satisfying the requirements of the invention has been prepared, it can be blended with one or more other novel emulsions according to this invention or with any other conventional emulsion. Conventional emulsion blending is illustrated in *Research Disclosure*, Vol. 308, December 1989, Item 308119, Section I.

Any suitable tetraazaindene may be used in the method of the invention. Suitable for the invention are compounds of Formula II:

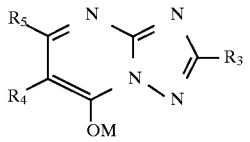

(II)

wherein $R_3$, $R_4$, and $R_5$ can independently be chosen from hydrogen, bromo, cyano, mercapto, carboxy, alkyl or substituted alkyl including carboxy alkyl and thio alkyl, unsubstituted or substituted aryl, where alkyl and aryl groups have 12 or fewer carbon atoms and can optionally be linked through a divalent oxygen or sulfur atom; and M is hydrogen, alkali metal, or quaternized ammonium ion. The preferred alkali metals for M are sodium and potassium. Hydrogen is the most preferred M.

The preferred tetraazaindenes have a $pK_a$ of less than or equal to 6 and/or an anchor group suitably thioalkyl or mercapto. An anchor group enables a compound to absorb to silver halide surfaces more tightly than it would if a different compound was present.

Preferred tetraazaindenes are AF-1, AF-2, and AF-1A

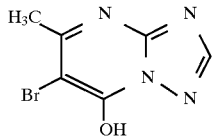

(AF-1)

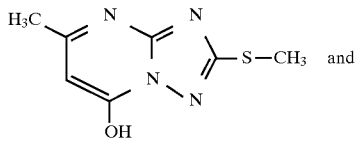

(AF-2)

and

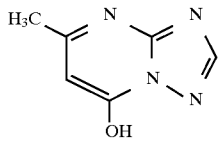

(AF-1A)

Any hexose reductone may be utilized in the invention. Suitable are the hexose reductones of Formula IA:

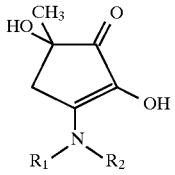

IA $R_1$=$R_2$=$CH_3$ HR-1

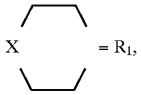

X=O HR-2

X=$CH_2$ HR-3

Preferred hexose reductones are HR-1, HR-2, and HR-3. It has been found that the hexose reductone can be added to the cyan, magenta or yellow dispersion melts of a color negative material incorporating ultrathin tabular silver halide grains having epitaxial areas. The preferred hexose reductones significantly reduced magenta density loss with latent image keeping.

The amount of hexose reductone utilized suitably is between $5.12\times10^{-9}$ mol/m$^2$ and $1.02\times10^{-4}$ mol/m$^2$. A preferred amount is between $5.12\times10^{-7}$ mol/m$^2$ and $5.12\times10^{-5}$ mol/m$^2$.

Other addenda that may be added with the hexose reductone and tetraazaindene of the invention include organic dichalcogenides such as disulfides, chalcogenazoliums such as thiazoliums, and gold compounds of very low water solubility such as gold sulfide or palladium compound such as chloropalladate.

Suitable organic dichalcogenides of the invention may be represented by Formula III.

$$R_6—X_2—X_3—R_7 \qquad \text{(Formula III)}$$

In the above formula $X_2$ and $X_3$ are independently S, Se, or Te; and $R_6$ and $R_7$, together with $X_2$ and $X_3$, form a ring system, or are independently substituted or unsubstituted cyclic, acyclic or heterocyclic groups. Preferably the molecule is symmetrical and $R_6$ and $R_7$ are alkyl or aryl groups. Preferred is the combination of $R_6$ and $R_7$ resulting in a dichalcogenide with a molecular weight greater than 210 g/mol. $R_6$ and $R_7$ cannot be groups which cause the compound to become labile, such as for example,

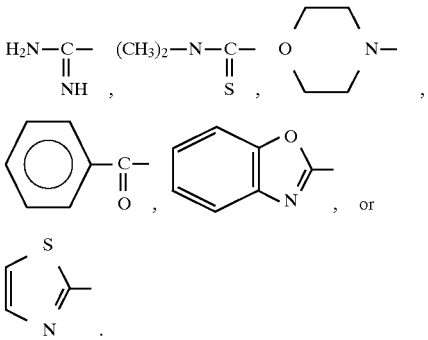

Some examples of preferred compounds are shown below.

EXAMPLES OF FORMULA III $R_6-X_2-X_3-R_7$

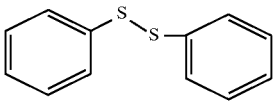

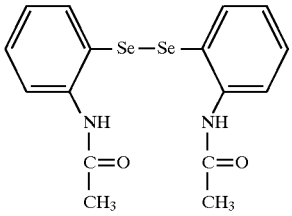

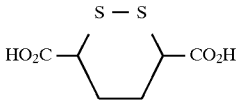

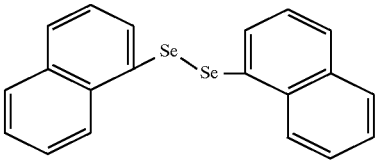

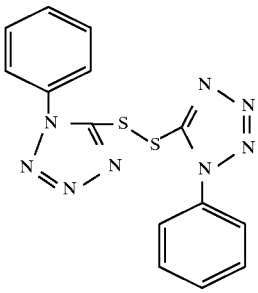

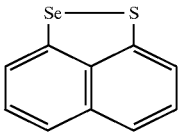

$HO_2C(CH_2)_4-Se-Se-(CH_2)_4CO_2H$

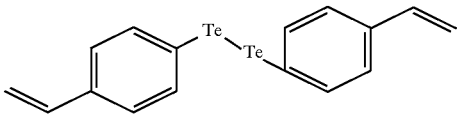

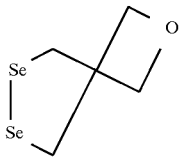

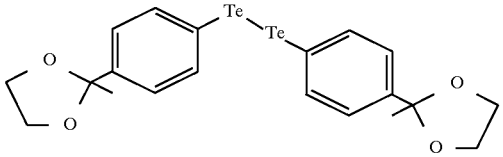

-continued

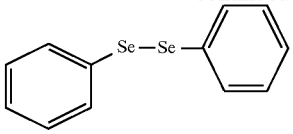

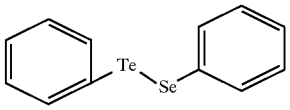

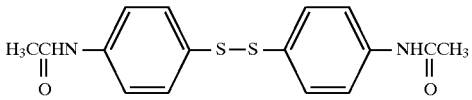

D-1

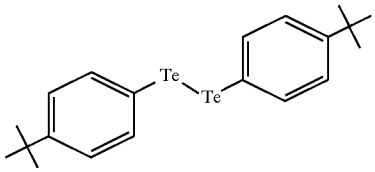

The dichalcogen must be non-labile meaning it does not release elemental chalcogen or chalcogen anion under specified conditions for making conventional photographic emulsions or the resulting photographic element. A preferred compound of the invention is D-1 above.

Any suitable chalcogenazolium represented by Formula (IV) may be utilized.

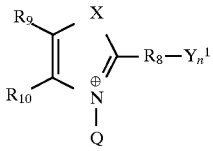

(IV)

$R_8$ is hydrogen, alkyl of from 1 to 8 carbon atoms, or aryl of from 6 to 10 carbon atoms;

$R_9$ and $R_{10}$ are independently hydrogen or halogen atoms, aliphatic or aromatic hydrocarbon moieties optionally linked through a divalent oxygen or sulfur atom; or cyano, amino, amido, sulfonamido, sulfamoyl, ureido, thioureido, hydroxy, —C(O)M, or —$S(SO)_2M$ groups, wherein M is chosen to complete an aldehyde, ketone, acid, ester, thioester, amide, or salt; or $R_9$ and $R_{10}$ together represent the atoms completing a fused ring;

Q represents a quaternizing substituent;

X is a middle chalcogen atom (S, Se, or Te);

$Y^1$ represents a charge balancing counter ion; and n is the integer 0 or 1.

In a preferred form $R_9$ and $R_{10}$ together form one or more fused carbocyclic aromatic rings, e.g., benzo or naphtho ring, either of which can be optionally substituted.

It has been recognized that ring hydrolysis of the chalcogenazolium compounds is important to their log inhibiting activity. This hydrolysis may be accomplished deliberately, or it may occur spontaneously when incorporated into silver halide emulsions of appropriate pH. When hydrolyzed, the compounds of Formula (IV) can be represented by Formula (V) (omit X—O bond):

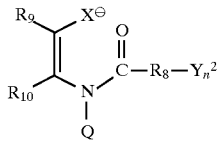

(V)

wherein $R_8$, $R_9$, $R_{10}$, Q, X, and n are as previously defined, and $Y^2$ is a change balancing counter ion.

An improved speed/fog relationship can be realized by modification of the quaternizing substituent of any quaternized chalcogenazolium salt of a middle chalcogen which is capable of undergoing hydrolysis in the manner indicated. Conventional quaternizing substituents are optionally substituted hydrocarbon substituents, sometimes including a carbon chain interrupting group, such as an oxy, carboxy, carbamoyl, or sulfonamido group. A preferred embodiment is the use of a quaternizing substituent having a divalent group satisfying Formula (VI):

$$-T-(\overset{H}{N}-T_1)_m- \quad \text{(VI)}$$

where:

T and $T_1$ are independently carbonyl (CO) or sulfonyl ($SO_2$) and m is an integer of from 1 to 3.

In a specific preferred form the quaternizing substituent, e.g., Q, can be alkyl, aryl, or can take the form represented by Formula (VII):

$$-L-T-(\overset{H}{N}-T_1)_m-R_{11} \quad \text{(VII)}$$

wherein

T is carbonyl or sulfonyl;

$T_1$ is independently in each occurrence carbonyl or sulfonyl; and

L represents a divalent linking group, such as an optionally substituted divalent hydrocarbon group;

$R_{11}$ represents an optionally substituted hydrocarbon residue or an amino group; and m is an integer of from 1 to 3.

In preferred embodiments of the invention T is carbonyl and $T_1$ is sulfonyl. However, either or both of T and $T_1$ can be either carbonyl or sulfonyl. Further, where m is greater than 1, $T_1$ can in each occurrence be carbonyl or sulfonyl independently of other occurrences.

L is preferably an alkylene (i.e., alkanediyl) group of from 1 to 8 carbon atoms. In specifically preferred forms of the invention L is either methylene (—$CH_2$—) or ethylene (—$CH_2CH_3$—).

$R_{11}$ is preferably a primary or secondary amino group, an alkyl group of from 1 to 8 carbon atoms (e.g., methyl, ethyl, propyl, i-propyl, n-butyl, i-butyl, t-butyl, neopentyl, or n-octyl), or an aryl group of from 6 to 10 carbon atoms (e.g., phenyl or naphthyl). When $R_{11}$ completes a secondary amine, it can be substituted with an optionally substituted hydrocarbon residue, preferably an alkyl group of from 1 to 8 carbon atoms or an aryl group of 6 to 10 carbon atoms, as above described. It is also recognized that $R_{11}$ can be chosen, if desired, to complete a bis compound. For example, $R_{11}$ can take a form similar to L, and the hydrolyzed chalcogenazolium ring linked to L, thereby incorporating a second hydrolyzed chalcogenazolium ring into the fog-inhibiting agent.

The most preferred compounds are AF-3 and AF-4 shown below.

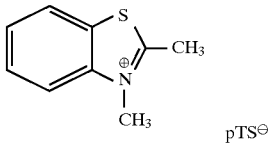

AF-3

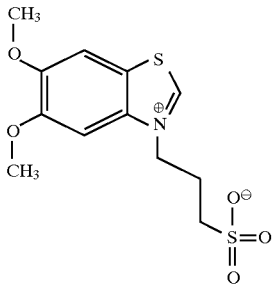

The suitable palladium compounds are disclosed in the coassigned and copending U.S. Ser. No. 08/566,770 filed Dec. 4, 1995. A preferred palladium compound is Bis-(1,2-ethandiamine-N,N')palladium(2+)dichloride.

The sparingly soluble gold compounds suitable for the invention are disclosed in U.S. Pat. No. 2,597,915. $Au_2S$ (AF-5) is the preferred sparingly soluble gold compound.

Emulsions of the invention find their preferred use in color negative films. The high sensitivity and fine grain allow the production of their desirable high speed fine grain imaging films.

The optimal amount of each of the antifoggants depends on the desired final result, and emulsion variables such as composition of host and epitaxy, choice and level of sensitizing dye, and level and type of chemical sensitizers. Also it is understood that excess halide concentration (often expressed as pBr) and pH can be varied. Suitable concentrations are as follows:

for the tetraazaindene: 0.00001 to 1 mole/mole. Ag with the preferred range being 0.0001 to 0.10 moles/mole Ag, for the organic dichalcogenide: 0.0000001 to 0.01 moles/mole Ag with the preferred range being 0.000001 to 0.001 moles/mole Ag, for the chalcogenazolium: 0.00001 to 0.5 mole/mole Ag with the preferred range being 0.0001 to 0.05 moles/mole Ag, for the sparingly soluble gold compound: 0.00000001 to 0.0001 moles/mole Ag with the preferred range being 0.0000001 to 0.00001 moles, and for the palladium compound: 0.0000001 to 0.01 moles/mole Ag, with the preferred range being 0.000001 to 0.001 moles/mole Ag.

Relevant to use in the photographic elements of the invention are tabular grain silver halide emulsions that have thicknesses of 0.07 microns or greater which can be comprised of silver bromide, silver chloride, silver iodide, silver chlorobromide, silver chloroiodide, silver bromoiodide, and silver chlorobromoiodide or mixtures thereof. Such emulsions are disclosed by Wilgus, et al. U.S. Pat. No. 4,434,226; Daubendiek, et al. U.S. Pat. No. 4,414,310; Wey U.S. Pat. No. 4,399,215; Solberg, et al. U.S. Pat. No. 4,433,048; Mignot U.S. Pat. No. 4,386,156; Evans, et al; U.S. Pat. No. 4,504,570; Maskasky U.S. Pat. Nos. 4,435,501 and 4,643,966; and Daubendiek et al. U.S. Pat. Nos. 4,672,027 and 4,693,964. Also specifically contemplated are those silver bromoiodide grains with a higher molar portion of iodide in the core than in the periphery of the grain, such as those described in GB 1,027,146; JA 54/48,521; U.S. Pat. Nos. 4.379,837; 4,444,877; 4,665,614; 4,636,461; EP 264,954. These emulsions are chemically sensitized and spectrally dyed using methods now well known in the art. The physical characteristics of these emulsions, the bulk iodide level, and the spectral sensitizers are given in Tables I, II, and III.

The ultrathin tabular grain emulsions that are useful in the present invention have thicknesses of less than 0.07 microns and can be comprised of silver bromide, silver chloride, silver iodide, silver chlorobromide, silver chloroiodide, silver bromoiodide, and silver chlorobromoiodide or mixtures thereof. Of particular usefulness are the silver bromoiodides. See the above patents for the preparation of such emulsions.

The reductone containing emulsion of the invention may be used in any layer in the photographic element. The reductone tends to move between the layers during formation of the photographic element and, therefore, the layer of addition is less critical. The reductone may suitably be added to the coupler dispersion or to the emulsion prior to coating. Further, it may be added as a doctor immediately prior to coating of the layers of the photographic element. The latent image stabilizing compound of this invention can be added to imaging or non-imaging layers of the photographic element. A preferred place of addition has been found to be into the coupler dispersion prior to its being combined with the silver halide grains of the emulsion, as this provides a latent image keeping improvement with minimal effect on speed of the silver halide grains.

The photographic elements formed by the invention may utilize conventional peptizing materials and be formed on conventional base materials such as polyester and paper. Further, other various conventional plasticizers, antifoggants, brighteners, bacterialcides, hardeners and coating aids may be utilized. Such conventional materials are found in *Research Disclosure*, Item 308119 of December, 1989 and *Research Disclosure*, Item 38957 of September 1996.

A preferred color photographic element according to this invention comprises a support bearing at least one blue-sensitive silver halide emulsion layer having associated therewith a yellow dye-forming coupler, at least one green-sensitive silver halide emulsion layer having associated therewith a magenta dye-forming coupler and at least one red-sensitive silver halide emulsion layer having associated therewith a cyan dye-forming coupler, at least one of the silver halide emulsions layers containing a latent image stabilizing compound of this invention. In accordance with a particularly preferred aspect of the present invention, the invention compound is contained in a magenta dye-forming green-sensitive silver emulsion.

The elements of the present invention can contain additional layers conventional in photographic elements, such as overcoat layers, spacer layers, filter layers, antihalation layers, scavenger layers, and the like. The support can be any suitable support used with photographic elements. Typical supports include polymeric films, paper (including polymer-coated paper), glass, and the like. Details regarding supports and other layers of the photographic elements suitable for this invention are contained in *Research Disclosure*, Item 17643, December 1978, and *Research Disclosure*, Item 38957 of September 1996.

The invention is illustrated with the following examples which distinguish the invention from prior art through demonstration of superior fresh speed, Dmin, and contrast responses, improved stability in accelerated raw stock aging tests, or differences in latent image stability:

The following structures were used in the multilayer examples:

B-1

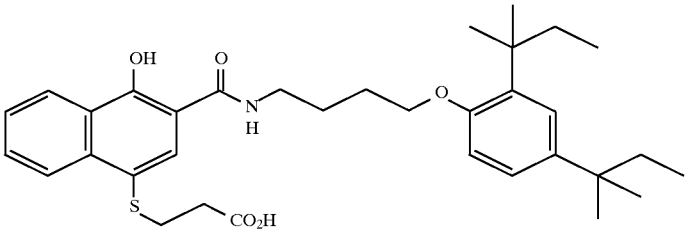

C-1

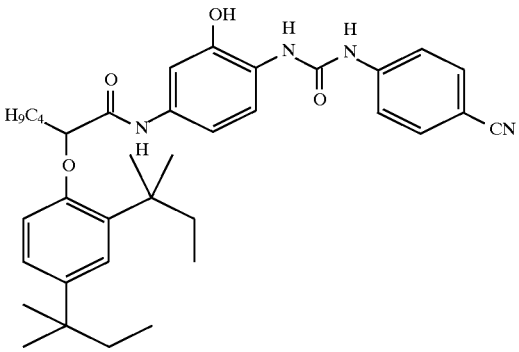

-continued
DIR-1
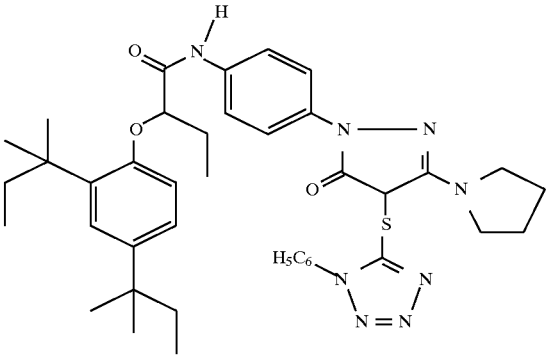
DIR-2
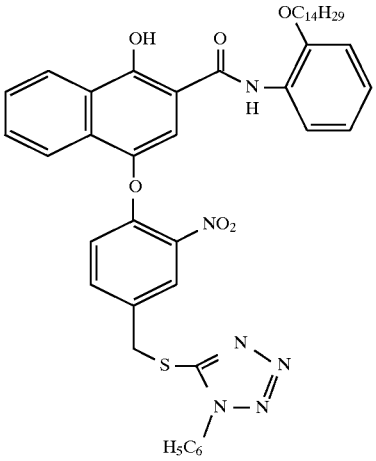
DIR-3
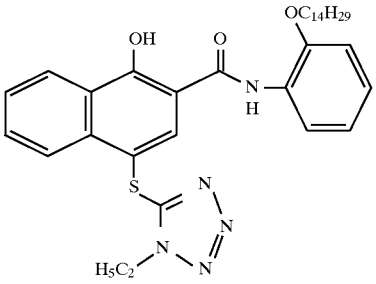
DIR-4
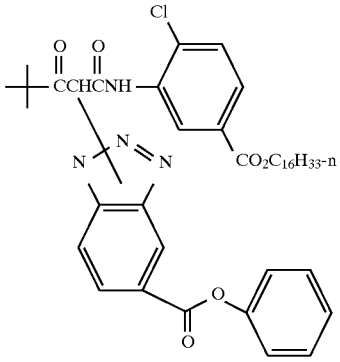
DYE-1
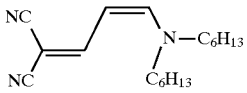

-continued
DYE-2
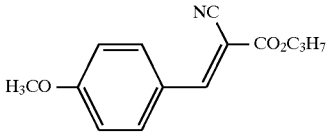
DYE-3
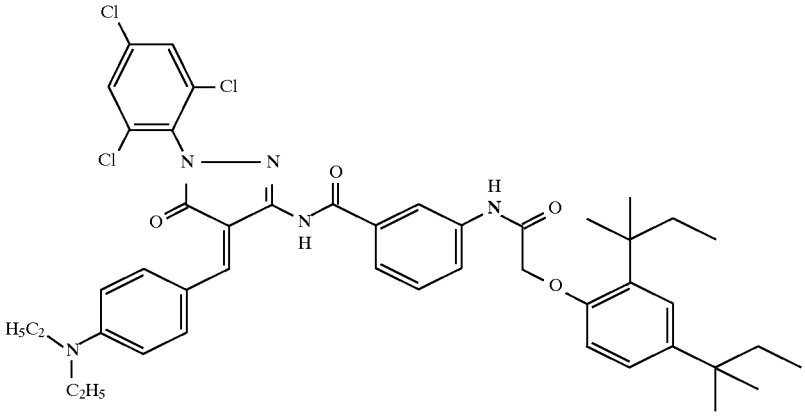
DYE-4
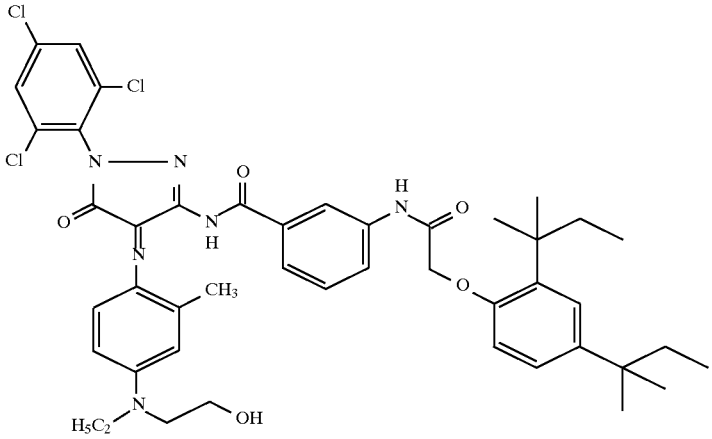
DYE-5
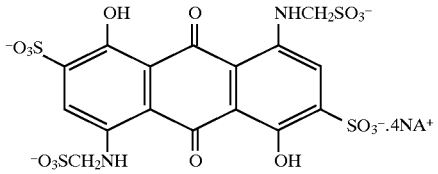
DYE-6
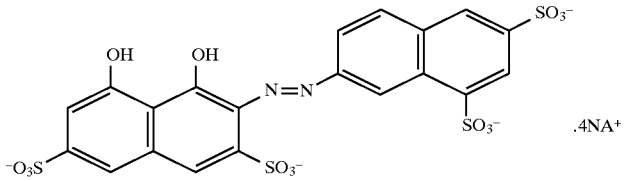
DYE-7
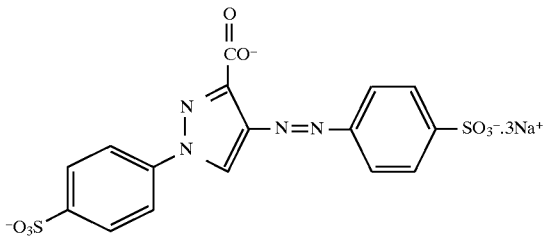

-continued
DYE-8
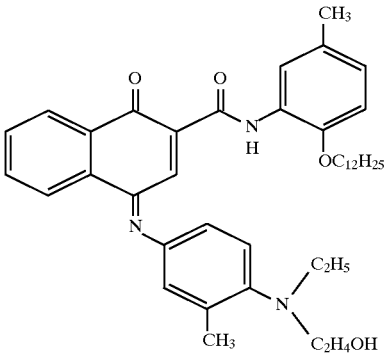
DYE-9
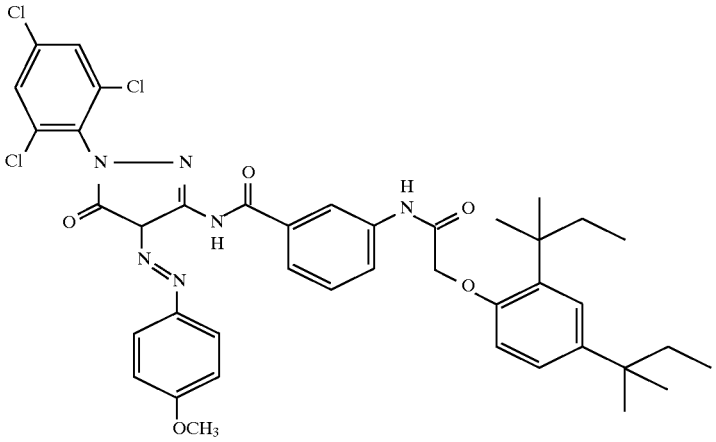
M-1
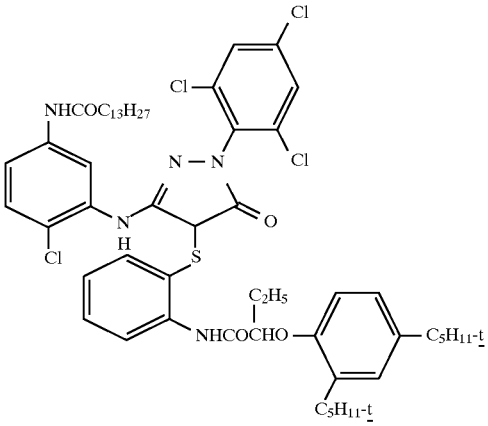

-continued
MC-1
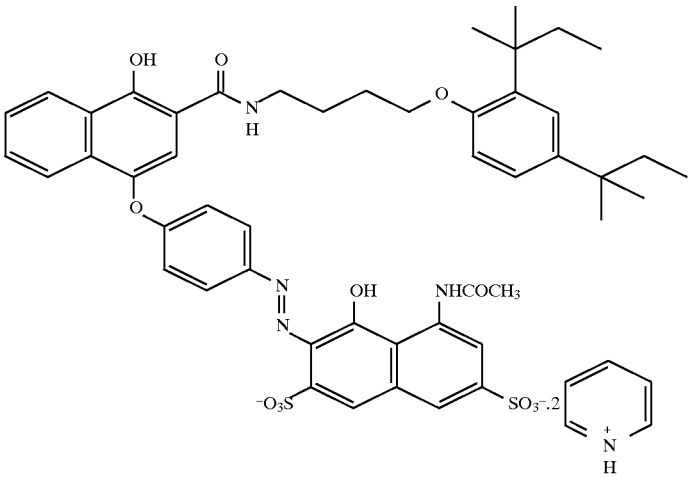
MC-2
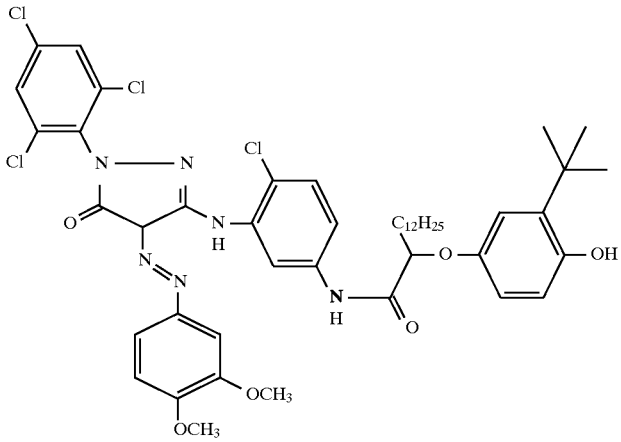
OxDS-1
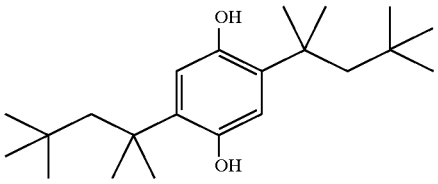
SD-1
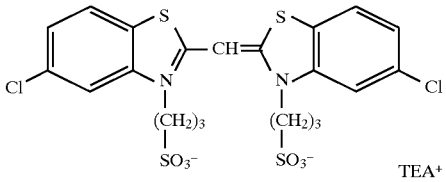
SD-2
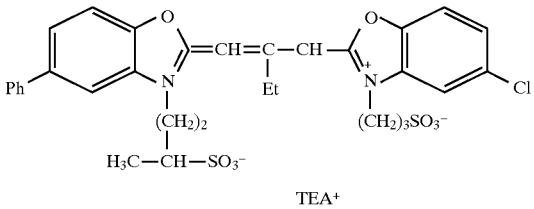

-continued
SD-3
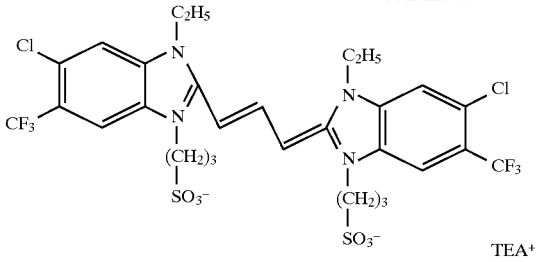
SD-4
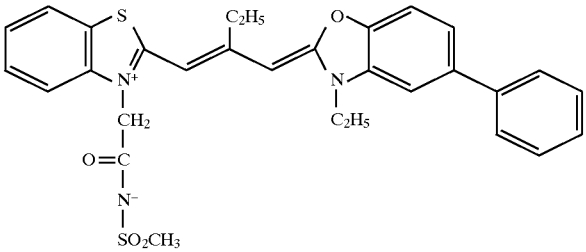
SD-5
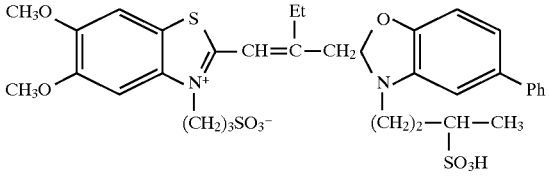
SD-6
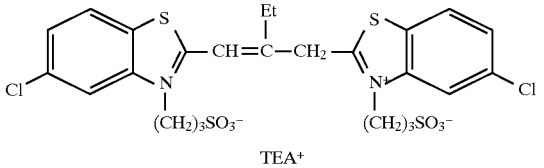
SD-7
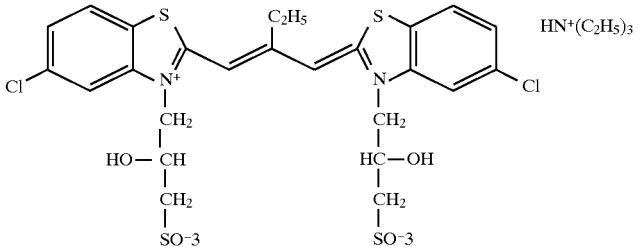
SD-8
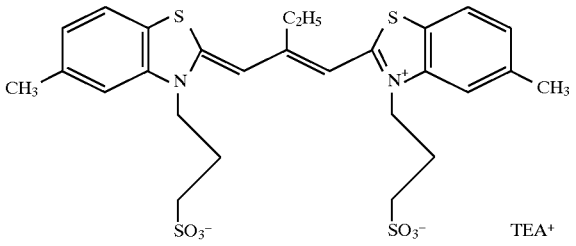
Y-1
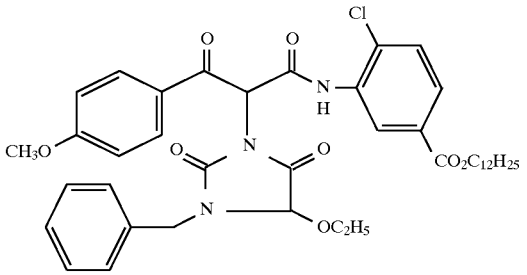

-continued

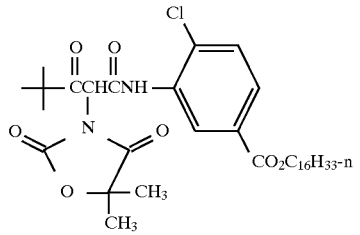

Y-2

EXAMPLES

An example of the procedure used to make and finish the ultrathin emulsions TC-6 and TC-7 described in Table I is as follows:

A series of ultrathin tabular grain emulsions of 1.0 to 3.0 microns by 0.04 to <0.07 microns containing 3 mole % iodide were prepared by running AgI together with $AgNO_3$ and NaBr under carefully controlled conditions of pH, gelatin content and vAg as described in U.S. Pat. No. 5,250,403 was sensitized as described in published EP 94 119 840.0 with 2-butynyl aminobenzoxazole. Chemical sensitizations were performed using 1,3-dicarboxymethyl-1,3-dimethyl-2-thiourea as the sulfur source as described in U.S. Pat. No. 4,810,626 and aurous bis(1,4,5-trimethyl-1,2-4-triazolium-3-thiolate) as the gold source as described in U.S. Pat. No. 5,049,485. The specific sensitization procedure involved the sequential addition to a tabular grain emulsion of sodium thiocyanate, a finish modifier (3-(2-methylsulfamoylethyl)-benzothiazolium tetrafluoroborate, a yellow sensitizing dye as noted in Table I, the addition of 2-butynyl aminobenzoxazole, followed by the sulfur and gold sensitization. The emulsion was then incubated at 55° C. for 15 min, cooled to 40° C. and 1-(3-acetamidophenyl)-5-mercaptotetrazole was added after the heat incubation.

Emulsions TC-3, TC-4, TC-13 and TC-14 can be generally described as banded-I emulsions that contain 1.5 mole % I in the inner 75% of the make and 12 mole % I in the outer 25% of the make. An illustrative example for making this type of emulsion follows.

A vessel equipped with a stirrer was charged with 6 L of water containing 3.75 g lime-processed bone gelatin, 4.12 g NaBr, an antifoamant, and sufficient sulfuric acid to adjust pH to 1.8, at 39° C. During nucleation, which was accomplished by balanced simultaneous 4 sec. addition of $AgNO_3$. and halide (98.5 and 1.5 mole % NaBr and KI, respectively) solutions, both at 2.5M, in sufficient quantity to form 0.01335 moles of Ag(Br, I), pBr and pH remained approximately at the values initially set in the reactor solution. Following nucleation, the reactor gelatin was quickly oxidized by addition of 128 mg of Oxone ($2KHSO_5.KHSO_4.K_2SO_4$ purchased from Aldrich Chemical Co.) in 20 mL $H_2O$, and the temperature was raised to 54° C. in 9 min. After the reactor and contents were held at this temperature for 9 min, 100 g of oxidized lime-processed bone gelatin dissolved in 1.5 L $H_2O$ at 54° C. was added to the reactor. Next the pH was raised to 5.90, and 122.5 mL of 1M NaBr was added to the reactor. Twenty four and a half minutes after nucleation, the growth stage was begun during which 2.5M $AgNO_3$, 2.8M NaBr, and a 0.0503M suspension of AgI were added in proportions to maintain a uniform iodide level of 1.5 mole % in the growing silver halide crystals, and the reactor pBr at the value resulting from the cited NaBr additions prior to start of nucleation and growth. This pBr was maintained until 0.825 moles of Ag(Br,I) had formed (constant flow rates for 40 min), at which time the excess $Br^-$ concentration was increased by addition of 105 mL of 1M NaBr; the reactor pBr was maintained at the resulting value for the balance of the growth. Flow rate of $AgNO_3$ was accelerated so that the flow rate at the end of this 53.2 min segment was 10×that at the beginning. After 6.75 moles of emulsion had formed (1.5 mole-% I), the ratio of flows of AgI to $AgNO_3$ was changed such that the remaining portion of the 9 mole batch was 12 mole % I. During formation of this high iodide band, flow rate at the start of this segment, based on rate of total Ag delivered to the reactor, was approximately 25% as great as at the end of the previous segment, and it was accelerated such that the ending flow rate was 1.6 times that at the beginning of this segment. When addition of $AgNO_3$, AgI, and NaBr was complete, the resulting emulsion was washed by ultrafiltration and pH and pBr were adjusted to storage values of 6 and 2.5, respectively.

The resulting emulsion was examined by scanning electron micrography (SEM) and mean grain area was determined using a Summagraphics SummaSketch Plus sizing tablet that was interfaced to a computer: more than 90 number-% of the crystals were tabular, and more than 95% of the projected area was provided by tabular crystals. The mean diameter was 1.98 mm (coefficient of variation=41). Since this emulsion is almost exclusively tabular, the grain thickness was determined using a dye adsorption technique: The level of 1,1'-diethyl-2,2'-cyanine dye required for saturation coverage was determined, and the equation for surface area was solved for thickness assuming the solution extinction coefficient of this dye to be 77,300 L/mole cm and its site area per molecule to be 0.566 $nm^2$. This approach gave a thickness value of 0.050 mm.

TC-13 and TC-14 were green sensitized using a finishing procedure that led to the formation of a epitaxial deposit. In this description, all levels are relative to 1 mole of host emulsion. A 5 mole sample of the emulsion was liquified at 40° C. and its pBr was adjusted to ca. 4 with a simultaneous addition of $AgNO_3$ and KI solutions in a ratio such that the small amount of silver halide precipitated during this adjustment was 12% I. Next, 2 mole-% NaCl (based on the original amount of Ag(Br,I) host) was added, followed by addition of sensitizing dyes as described in Table II, after which 6 mole-% Ag(Cl,Br,I) epitaxy was formed by the following sequence of additions: 2.52% $Cl^-$ added as a $CaCl_2$ solution, 2.52% $Br^-$ added as a NaBr solution, 0.000030 moles $K_2Ru(CN)_6$ in a dilute water solution, 0.96% $I^-$ added as a AgI suspension, and 5.04% $AgNO_3$. The post-epitaxy components included 0.75 mg 4,4'-phenyl disulfide diacetanilide, 60 mg NaSCN/mole Ag, 2.52 mg 1,3-dicarboxymethyl-1,3-dimethyl-2-thiourea (disodium salt) (DCT) as sulfur sensitizer, 0.95 mg bis(1,4,5-trimethyl-1,2,4-triazolium-3-thiolate) gold(1) tetrafluoroborate (Au(1) TTT) as gold sensitizer, and 3.99 mg 3-methyl-1,3-benzothiazolium iodide (finish modifier). After all components were added, the mixture was heated to 50° C. for 15 min to complete the sensitization. Finally the sensitized emulsion was chilled and placed in a refrigerator until samples were taken for coatings.

TC-3 and TC-4 were given a similar finish except that red sensitizing dyes as noted in Table III were used in place of the green sensitizing dyes, 0.000060 rather than 0.000030 moles $K_2Ru(CN)_6$ was added, 2.9 mg DCT and 0.67 mg Au(1)TTT/mole Ag were used as S and Au sensitizers, and 5.72 mg 1-(-3-acetamidophenyl)-5-mercaptotetrazole/mole Ag was used as finish modifier in place of 3-methyl-1,3-benzothiazolium iodide.

TABLE I

Blue sensitized emulsions

| Emulsion ID | Mole % Iodide | ECD (microns) | Thickness (microns) | SD-1 (mmoles/mole) |
|---|---|---|---|---|
| TC-5 | 1.3 | 0.38 | 0.084 | 1.160 |
| TC-6 | 2.46 | 1.19 | 0.05 | 2.20 |
| TC-7 | 2.46 | 1.94 | 0.05 | 1.60 |
| TC-8 | 4.1 | 2.23 | 0.14 | 0.88 |

TABLE II

Green Sensitized Emulsions

| Emulsion ID | Mole % Iodide | ECD (microns) | Thickness (microns) | SD-2 (mmoles/mole) | SD-3 (mmoles/mole) | SD-4 (mmoles/mole) |
|---|---|---|---|---|---|---|
| TC-9 | 4.1 | 1.08 | 0.11 | 0.70 | | 0.16 |
| TC-10 | 4.1 | 1.04 | 0.11 | 0.66 | 0.22 | |
| TC-11 | 3.3 | 0.53 | na | 0.48 | | 0.12 |
| TC-12 | 3.3 | 0.53 | na | 0.45 | 0.15 | |
| TC-13 | 4.1 | 1.98 | 0.05 | 1.61 | | 0.210 |
| TC-14 | 4.1 | 1.98 | 0.05 | 1.29 | 0.43 | |

TABLE III

Red Sensitized Emulsions

| Emulsion ID | Mole % Iodide | ECD (microns) | Thickness (microns) | SD-5 (mmoles/mole) | SD-6 (mmoles/mole) | SD-7 (mmoles/mole) | SD-8 (mmoles/mole) |
|---|---|---|---|---|---|---|---|
| TC-1 | 1.3 | 0.38 | 0.084 | | 0.960 | | 0.106 |
| TC-2 | 4.1 | 0.54 | 0.12 | | 1.083 | | 0.118 |
| TC-3 | 4.1 | 0.937 | 0.054 | 0.380 | | 1.520 | |
| TC-4 | 4.1 | 1.98 | 0.05 | 0.290 | | 1.330 | |

Multilayer Photographic Elements of the Invention

Several multilayers were constructed, except as indicated otherwise, using the following layer order:

Support
Layer 1 (AHU-Anithalation Unit)
Layer 2 (Interlayer)
Layer 3 (Slow cyan imaging layer)
Layer 4 (Fast cyan imaging layer
Layer 5 (Interlayer)
Layer 6 (Slow magenta imaging layer)
Layer 7 (Mid magenta imaging layer)
Layer 8 (Fast magenta imaging layer
Layer 9 (Yellow filter layer)
Layer 10 (Slow yellow imaging layer)
Layer 11 (Fast yellow imaging layer
Layer 12 (UV Ultraviolet protection layer)
Layer 13 (Protective overcoat)

The general composition of the multilayer coatings follow. The examples used herein specify changes made in Layers 6, 7, and 8. Layers 1 through 5 and layers 9 through 13 are common for the described multilayer coatings.

| | | | |
|---|---|---|---|
| Layer 1: | 15.61 | mg/dm$^2$ | gelatin |
| | 3.88 | | black filamentary silver |
| | 0.75 | | UV absorber (DYE-2) |
| | 0.065 | | cyan pre-formed (DYE-8) |
| | 0.086 | | magenta pre-formed dye (DYE-4) |
| | 1.33 | | yellow -colored magenta dye former (DYE-9) |
| | 0.16 | | yellow tint (DYE-3) |
| | 0.07 | | soluble red filter dye (DYE 5) |
| Layer 2: | 5.38 | mg/dm$^2$ | gelatin |
| | 0.54 | | Dox scavenger (OxDS-1) |
| | 0.21 | | Gelatin thickener (T-1) |
| Layer 3: | 20.98 | mg/dm$^2$ | gelatin |
| | 1.38 | | slow-slow -cyan silver (TC-1) |
| | 0.57 | | slow -cyan silver (TC-2) |
| | 2.41 | | mid-cyan silver (TC-3) |
| | 6.71 | | cyan dye former (C-1) |
| | 0.54 | | cyan dye forming bleach accelerator (B-1) |
| | 0.19 | | cyan dye forming image modifier (DIR-2) |
| | 0.38 | | cyan dye forming image modifier (DIR-3) |
| | 0.19 | | magenta colored cyan dye forming masking coupler (MC-1) |
| Layer 4: | 13.99 | mg/dm$^2$ | gelatin |

-continued

| | | | |
|---|---|---|---|
| | 3.23 | | fast cyan silver (TC-4) |
| | 1.73 | | cyan dye former (C-1) |
| | 0.12 | | cyan dye forming image modifier (DIR-2) |
| | 0.46 | | cyan dye forming image modifier (DIR-3) |
| | 0.32 | | magenta colored cyan dye forming masking coupler (MC-1) |
| Layer 5: | 5.38 | mg/dm$^2$ | gelatin |
| | 0.54 | | Dox scavenger (OxDS-1) |
| | 0.21 | | Gelatin thickener (T-1) |
| Layer 6: | 11.84 | mg/dm$^2$ | gelatin |
| | 1.96 | | magenta silver |
| | 1.86 | | magenta dye forming coupler (M-1) |
| | 0.21 | | yellow colored magenta dye forming masking coupler (MC-2) |
| | 0.64 | | Gelatin thickener (T-1) |
| | 0.07 | | soluble green filter dye (Dye-6) |
| Layer 7: | 11.30 | mg/dm$^2$ | gelatin |
| | 1.72 | | magenta silver |
| | 1.08 | | magenta dye forming coupler (M-2) |
| | 0.64 | | yellow colored magenta dye forming masking coupler (MC-2) |
| | 0.04 | | magenta image modifier (DIR-1) |
| | 0.22 | | cyan dye forming image modifier (DIR-2) |
| | 0.11 | | Gelatin thickener (T-1) |
| Layer 8: | 11.30 | mg/dm$^2$ | gelatin |
| | 3.34 | | magenta silver |
| | 1.08 | | magenta dye forming coupler (M-1) |
| | 0.03 | | magenta image modifier (DIR-1) |
| | 0.40 | | Gelatin thickener (T-1) |
| Layer 9: | 5.38 | mg/dm$^2$ | gelatin |
| | 0.54 | | Dox scavenger (OxDS-1) |
| Layer 10: | 15.60 | mg/dm$^2$ | gelatin |
| | 1.23 | | slow-slow -yellow silver (TC-5) |
| | 0.71 | | slow-yellow silver (TC-6) |
| | 0.43 | | mid-yellow silver (TC-7) |
| | 9.28 | | yellow dye forming coupler (Y-2) |
| | 0.14 | | yellow dye forming image modifier (DIR-4) |
| | 0.04 | | cyan dye forming bleach accelerator (B-1) |
| | 0.40 | | Gelatin thickener (T- 1) |
| Layer 11: | 10.77 | mg/dm$^2$ | gelatin |
| | 2.20 | | mid yellow silver (TC-7) |
| | 1.68 | | fast yellow silver(TC-8) |
| | 1.61 | | yellow dye forming coupler (Y-1) |
| | 1.61 | | yellow dye forming coupler) (Y-2) |
| | 0.16 | | yellow dye forming image modifier (DIR-4) |
| | 0.05 | | cyan dye forming bleach accelerator (B-1) |
| | 0.07 | | Gelatin thickener (T-1) |
| | 0.21 | | soluble blue filter (Dye-7) |
| Layer 12: | 6.99 | mg/dm$^2$ | gelatin |
| | 1.08 | | Lippmann silver (K837) |
| | 1.08 | | UV absorber (Dye-1) |
| | 1.08 | | UV absorber (Dye-2) |
| Layer 13: | 8.88 | mg/dm$^2$ | gelatin |
| | 1.08 | | soluble matte beads |
| | 0.05 | | permanent matte beads |
| | lubricants | | |
| | 1.60% | BVSM | |
| | 4.9% | Glycerine | |

The speed of the coatings was determined by exposing the coatings to white light at 5500K using a carefully calibrated graduated density object. Exposure time was 0.02 sec. The exposed coating was then developed for 195 sec at 38° C. using the known C-41 color process as described, for example, in *The British Journal of Photographic Annual* 1988, pp196–198. The developed silver was removed in the 240 sec bleaching treatment, washed for 180 sec, and the residual silver salts were removed from the coating by a treatment of 240 sec in the fixing bath. The Status M densities of the processed strips were read and used to generate a characteristic curve (Density versus Log H). The speed for each color record (cyan, magenta, and yellow) of the coating was determined at a fixed density above the minimum density of the coating measured in an unexposed area using the equation $$\text{Speed}=100*(1-\text{Log H})$$

where Log H is the exposure that corresponds to 0.15 Status M density units above the minimum density. Speed differences are expressed as $$\text{Delta Speed}=\text{Test}—\text{Reference}$$

therefore, negative values are associated with test objects that are slower (have less speed) than the reference. Speed losses are undesired because they degrade both sensitivity and image structure of a photographic film.

Coatings of sensitized emulsions were tested for latent image keeping in the following manner: Two sets of results were compared. In the check case, strips of particular coatings were simply stored at conditions of 100° F. and 50% relative humidity for 4 weeks, then exposed and developed through the KODAK FLEXICOLOR C41 Process; this treatment is referred to as 4 wk 100° F./50%. The second identical group of strips was first stored at 100° F. and 50% relative humidity for 3 weeks, then exposed, and then stored at the same conditions for a fourth week before developing; this treatment is referred to as the 3 wk 100° F./50%+1 wk LIK. Speed differences between the check and exposed, then held strips are referred to as LIK changes: responses from the exposed, then held strips that are slower or faster than the check are referred to as LIK losses or grains, respectively. These speed differences are given in Tables IV–VI and are negative for LIK losses. The LIK effect may include density deviations that are greater than simple speed variations. The maximum density change between the check and the exposed, then held strips are also given in these Tables IV–VI.

Example A (Control)

This is a control example wherein a single test emulsion is used in Layers 6 through 8 at silver coverages as noted in the Example multilayer. In addition, the exclusive antifoggant used in these layers is AF-2. It is added to each of the Layers 6, 7, and 8 at the level of 25.4 mg/mole of silver. Six separate examples were prepared as follows:

A-1: Emulsion TC-9, a tabular grain emulsion, used in Layers 6,7,8

A-2: Emulsion TC-10, a tabular grain emulsion, used in Layers 6,7,8

A-3: Emulsion TC-11, a cubic emulsion, used in Layers 6,7,8

A-4: Emulsion TC-12, a cubic emulsion, used in Layers 6,7,8

A-5: Emulsion TC-13, an ultrathin tabular grain emulsion, used in Layers 6,7,8

A-6: Emulsion TC-14, an ultrathin tabular grain emulsion, used in Layers 6,7,8

The spectral sensitizations of these emulsions are given in Table II. The green LIK changes for these comparative examples are given in Table IV. It is clear from the presented data that all of the emulsions show large speed losses ranging from −8.4 to −10.3 with density losses ranging from −0.063 green record density units to −0.105 green record density units.

TABLE IV

Green LIK Changes for Controls: SMTAI-only at 25.4 mg/mole silver

| Example | Emulsion | Description | Green LIK Speed Loss | Maximum Density Loss |
|---|---|---|---|---|
| A-1 | TC-9 | Generic T-grain | −9.9 | −0.105 |
| A-2 | TC-10 | Generic T-grain | −9.6 | −0.085 |
| A-3 | TC-11 | Cube | −9.1 | −0.078 |
| A-4 | TC-12 | Cube | −8.4 | −0.078 |
| A-5 | TC-13 | Ultrathin Epitaxial T-grain | −10.3 | −0.075 |
| A-6 | TC-14 | Ultrathin Epitaxial T-grain | −9.0 | −0.063 |

Example B (Control)

This is a control example wherein a single test emulsion is used in Layers 6 through 8 at silver coverages as noted in the Example multilayer. The antifoggant used in Example A is also used in this example. In addition, a hexose reductone, HR-3, is added at $3.57\times10^{-5}$ mol/m$^2$. Four separate examples were prepared as follows:

B-1: Emulsion TC-9, a tabular grain emulsion, used in Layers 6,7,8

B-2: Emulsion TC-10, a tabular grain emulsion, used in Layers 6,7,8

B-3: Emulsion TC-11, a cubic emulsion, used in Layers 6,7,8

B-4: Emulsion TC-12, a cubic emulsion, used in Layers 6,7,8

The spectral sensitizations of these emulsions are given in Table II. The green LIK changes for these comparative examples are given in Table V. It is clear from the presented data that these emulsions show speed losses like that obtained in Examples A-1 through A-4. That is, the presence of the hexose reductone did not improve the latent image keeping of these emulsions.

TABLE V

Green LIK Changes for Controls: SMTAI at 25.4 mg/mole silver and PHR at $3.57\times10^{-5}$ mol/m$^2$

| Example | Emulsion | Description | Green LIK Speed Loss | Maximum Density Loss |
|---|---|---|---|---|
| B-1 | TC-9 | Generic T-grain | −9.7 | −0.095 |
| B-2 | TC-10 | Generic T-grain | −8.5 | −0.075 |
| B-3 | TC-11 | Cube | −9.3 | −0.070 |
| B-4 | TC-12 | Cube | −7.6 | −0.070 |

Example C (Invention)

This example is prepared like Example B except for the use of the following emulsions:

C-5: Emulsion TC-13, an ultrathin tabular grain emulsion, used in Layers 6,7,8

C-6: Emulsion TC-14, an ultrathin tabular grain emulsion, used in Layers 6,7,8

The spectral sensitizations of these emulsions are given in Table II. The green LIK changes for this invention are given in Table VI.

TABLE VI

Invention Green LIK Changes for Epitaxial T-grain with SMTAI at 25.4 mg/mole silver and PHR at $3.57\times10^{-5}$ mol/m$^2$

| Example | Emulsion | Description | Green LIK Speed Loss | Maximum Density Loss |
|---|---|---|---|---|
| C-5 | TC-13 | Ultrathin Epitaxial T-grain | −6.6 | −0.042 |
| C-6 | TC-14 | Ultrathin Epitaxial T-grain | −7.6 | −0.055 |

Comparing the comparative Example A-5 to the Invention, C-5, it is clear that the hexose reductone, HR-3, improved the green LIK speed loss wherein the invention is faster than the reference by +3.7 units of speed and has less density loss of 0.033 density units. Similar comparison exists between comparative example A-6 and the invention, C-6.

The addition of a hexose reductone such as HR-1, HR-2, or HR-3 to green sensitized epitaxially finished tabular grain emulsions improved the latent image keeping of these emulsions.

The invention has been described in detail with particular reference to preferred embodiments thereof, but it will be understood that variations and modifications can be effected within the spirit and scope of the invention.

We claim:

1. An emulsion comprising silver halide grains, said grains being tabular and comprising sensitizing dye(s) and silver salt epitaxial deposits, and as addenda a tetraazaindene and a hexose reductone represented by Formula I:

I

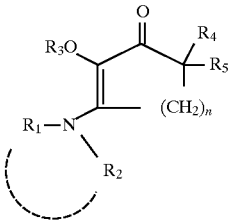

wherein $R_1$ and $R_2$ are the same or different, and may represent H, alkyl, cycloalkyl, aryl, or an alkyl group with a solubilizing group such as —OH, sulfonamide, sulfamoyl, or carbamoyl, $R_1$ and $R_2$ may be joined to complete a heterocyclic ring, $R_4$ and $R_5$ are H, OH, alkyl, aryl, cycloalkyl, or may together represent an alkylidene group, n is 0,1, or 2 and $R_3$ is H, alkyl, aryl, or $CO_2R_6$ where $R_6$ is alkyl.

2. The emulsion of claim 1 further comprising the addenda organic dichalcogenide.

3. The emulsion of claim 1 further comprising the addenda chalcogenazolium.

4. The emulsion of claim 3 wherein said chalcogenazolium comprises a benzothiazole.

5. The emulsion of claim 1 further comprising as an addenda a gold compound of low water solubility.

6. The emulsion of claim 5 wherein said gold compound comprises disulfide.

7. The emulsion of claim 1 further comprising as an addenda a palladium compound.

8. The emulsion of claim 1 wherein said emulsion is free of mercaptotetrazole.

9. The emulsion of claim 1 wherein said tetraazaindene comprises at least one member selected from the group consisting of AF-1A, AF-1, and AF-2

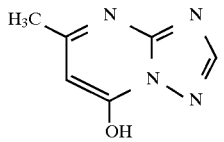

(AF-1A)

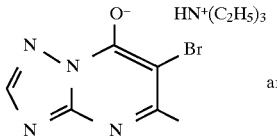

AF-1 and

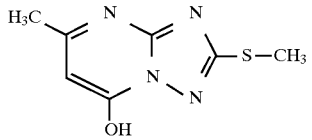

AF-2

10. The emulsion of claim 1 wherein said tetraazaindene has a pKa of less than 6.

11. The emulsion of claim 1 wherein said tetraazaindene comprises an anchor group that increases the affinity of said tetraazaindene for silver halide.

12. The emulsion of claim 1 wherein said hexose reductone comprises dimethylamino hexose reductone.

13. The emulsion of claim 1 wherein said hexose reductone comprises a member selected from the group consisting of morpholino hexose reductone and piperdino hexose reductone.

14. The emulsion of claim 1 wherein said tetraazaindene is present in an amount between 0.0001 and 0.10 moles/mole silver.

15. The emulsion of claim 1 wherein said Formula I compound comprises 2,5-dihydroxy-5-methyl-3-(1-piperidinyl)-2-cyclopentene-1-one.

16. The emulsion of claim 1 wherein said hexose reductone is present in an amount between about $5.12\times10^{-9}$ mol/m$^2$ and $1.02\times10^{-4}$ mol/m$^2$.

17. The emulsion of claim 1 wherein said hexose reductone of Formula IA:

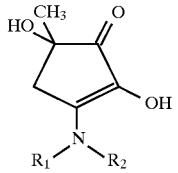

IA $R_1$=$R_2$=$CH_3$ HR-1

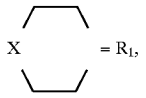

X=O HR-2

X=$CH_2$ HR-3.

18. The emulsion of claim 17 said tabular silver halide grains (a) having {111} major faces, (b) containing greater than 70 mole percent bromide and at least 0.25 mole percent iodide, based on silver, (c) accounting for greater than 90 percent of total grain projected area, (d) exhibiting an average equivalent circular diameter of at least 0.7 μm, (e) exhibiting an average thickness of less than 0.07 μm, and (f) having latent image forming chemical sensitization sites on the surfaces of the tabular grains, and a spectral sensitizing dyes adsorbed to at least the major faces of the tabular grains, wherein the surface chemical sensitization sites include at least one silver salt epitaxially located on and confined to the laterally displaced regions of said tabular grains.

19. The emulsion of claim 18 wherein said tetraazaindene comprises

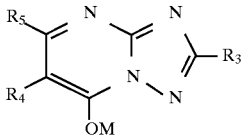

(II)

wherein $R_3$, $R_4$, and $R_5$ can independently be chosen from hydrogen, bromo, cyano, mercapto, carboxy, alkyl or substituted alkyl including carboxy alkyl and thio alkyl, unsubstituted or substituted aryl, where alkyl and aryl groups have 12 or fewer carbon atoms and can optionally be linked through a divalent oxygen or sulfur atom; and M is hydrogen, alkaline earth, or quaternized ammonium ion.

20. The emulsion of claim 18 wherein at least a portion of the tabular grains sufficient to improve speed-granularity relationships of the emulsion having a central region extending between said major faces, said central region having a lower concentration of iodide than a laterally displaced region also extending between said major faces and forming the edges and corners of the tabular grains.

21. The emulsion of claim 18 wherein the silver salt epitaxy (a) is of isomorphic face centered cubic crystal structure, (b) includes at least a 10 mole percent higher chloride ion concentration than the tabular grains, and (c) includes an iodide concentration that is increased by iodide addition during the epitaxy formation step.

22. The emulsion of claim 18 wherein the silver salt epitaxy contains a photographically useful metal ion dopant in which said metal ion displaces silver in the crystal lattice of the epitaxy, exhibits a positive valence of from 2 to 5, has its highest energy electron occupied molecular orbital filled and its lowest energy unoccupied molecular orbital at an energy level higher than the lowest energy conduction band of the silver halide lattice forming the epitaxial protrusions.

23. The emulsion of claim 17 wherein said hexose reductone is present in an amount between about $5.12\times10^{-7}$ mol/m$^2$ and $5.12\times10^{-5}$ mol/m$^2$.

24. The emulsion of claim 1 wherein $R_1$ and $R_2$ are joined to form a heterocyclic ring selected from the group consisting of aziridinyl, azetidinyl, pyrrolidinyl, piperidinyl, morpholinyl, piperazinyl, or pyridinyl.

25. A photographic element wherein at least one layer of said element comprises an emulsion comprising silver halide grains, said grains being tabular and comprising sensitizing dye(s) and silver salt epitaxial deposits, and as addenda a tetraazaindene and a hexose reductone represented by Formula I:

I

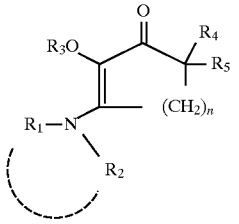

wherein $R_1$ and $R_2$ are the same or different, and may represent H, alkyl, cycloalkyl, aryl, or an alkyl group with a solubilizing group such as —OH, sulfonamide, sulfamoyl, or carbamoyl, $R_1$ and $R_2$ may be joined to complete a heterocyclic ring, $R_4$ and $R_5$ are H, OH, alkyl, aryl, cycloalkyl, or may together represent an alkylidene group, n is 0,1, or 2 and $R_3$ is H, alkyl, aryl, or $CO_2R_6$ where $R_6$ is alkyl.

26. The element of claim 25 wherein said emulsion further comprises as an addenda organic dichalcogenide.

27. The element of claim 25 wherein said emulsion further comprises as an addenda chalcogenazolium.

28. The element of claim 25 wherein said emulsion further comprises as an addenda gold disulfide.

29. The element of claim 25 wherein said emulsion is free of mercaptotetrazole.

30. The element of claim 25 wherein said tetraazaindene comprises at least one member selected from the group consisting of AF-1A, AF-1, and AF-2

(AF-1A)

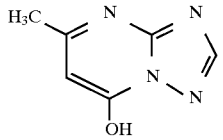

AF-1

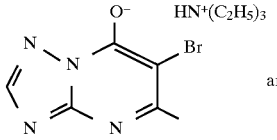

and

AF-2

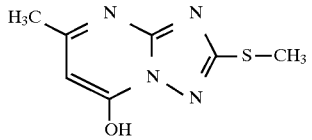

31. The element of claim 25 said tabular silver halide grains (a) having {111} major faces, (b) containing greater than 70 mole percent bromide and at least 0.25 mole percent iodide, based on silver, (c) accounting for greater than 90 percent of total grain projected area, (d) exhibiting an average equivalent circular diameter of at least 0.7 $\mu$m, (e) exhibiting an average thickness of less than 0.07 $\mu$m, and (f) having latent image forming chemical sensitization sites on the surfaces of the tabular grains, and a spectral sensitizing dye adsorbed to at least the major faces of the tabular grains, wherein the surface chemical sensitization sites include at least one silver salt epitaxially located on and confined to the laterally displaced regions of said tabular grains.

32. The element of claim 31 wherein said tetraazaindene comprises (II)

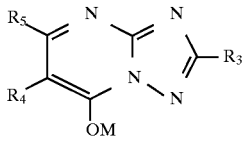

wherein $R_3$, $R_4$, and $R_5$ can independently be chosen from hydrogen, bromo, cyano, mercapto, carboxy, alkyl or substituted alkyl including carboxy alkyl and thio alkyl, unsubstituted or substituted aryl, where alkyl and aryl groups have 12 or fewer carbon atoms and can optionally be linked through a divalent oxygen or sulfur atom; and M is hydrogen, alkaline earth, or quaternized ammonium ion.

33. The element of claim 32 wherein said hexose reductone of said Formula I comprises Formula IA:

IA

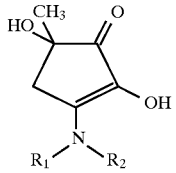

$R_1$=$R_2$=$CH_3$ HR-1

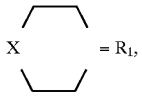

X=O HR-2

X=$CH_2$ HR-3.

34. The element of claim 33 wherein said hexose reductone is present in an amount between about $5.12\times10^{-7}$ mol/m$^2$ and $5.12\times10^{-5}$ mol/m$^2$.

35. The element of claim 31 wherein at least a portion of the tabular grains sufficient to improve speed-granularity relationships of the emulsion having a central region extending between said major faces, said central region having a lower concentration of iodide than a laterally displaced region also extending between said major faces and forming the edges and corners of the tabular grains.

36. The element of claim 31 wherein the silver salt epitaxy (a) is of isomorphic face centered cubic crystal structure, (b) includes at least a 10 mole percent higher chloride ion concentration than the tabular grains, and (c) includes an iodide concentration that is increased by iodide addition during the epitaxy formation step.

37. The element of claim 25 wherein said hexose reductone comprises dimethylamino hexose reductone.

38. The element of claim 25 wherein said hexose reductone comprises a member selected from the group consisting of morpholino hexose reductone and piperdino hexose reductone.

39. The photographic element of claim 25 wherein $R_1$ and $R_2$ are joined to form a heterocyclic ring selected from the group consisting of aziridinyl, azetidinyl, pyrrolidinyl, piperidinyl, morpholinyl, piperazinyl, or pyridinyl.

* * * * *

UNITED STATES PATENT AND TRADEMARK OFFICE

CERTIFICATE OF CORRRECTION

PATENT NO. : 5,773,208
DATED : June 30, 1998
INVENTOR(S) : Jeffrey L. Hall, et. al.

It is certified that error appears in the above-identified patent and that said Letters Patent is hereby corrected as shown below:

Title page, item [56], insert the followings:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 5 | 0 | 3 | 7 | 7 | 3 | 4 | 8/91 | Lenhard et al | | | |
| | | | | | | | | | | | | | |

Signed and Sealed this

Ninth Day of March, 1999

*Attest:*

Q. TODD DICKINSON

*Attesting Officer*

*Acting Commissioner of Patents and Trademarks*